US006470598B2

(12) United States Patent
Ringer

(10) Patent No.: US 6,470,598 B2
(45) Date of Patent: Oct. 29, 2002

(54) DECKEL EDGE PROFILER

(75) Inventor: Volker J. Ringer, Chateauguay (CA)

(73) Assignee: Asea Brown Boveri Inc., LaSalle (CA)

( * ) Notice: Subject to any disclaimer, the term of this patent is extended or adjusted under 35 U.S.C. 154(b) by 0 days.

(21) Appl. No.: 09/810,530

(22) Filed: Mar. 16, 2001

(65) Prior Publication Data

US 2001/0037582 A1 Nov. 8, 2001

(30) Foreign Application Priority Data

Mar. 17, 2000 (CA) ..... 2300842

(51) Int. Cl.[7] ..... F26B 13/00

(52) U.S. Cl. ..... 34/641; 34/309; 34/445; 34/463; 34/465; 34/487; 34/510; 34/640; 34/654; 34/229

(58) Field of Search ..... 34/307, 309, 419, 34/493, 494, 445, 459, 463, 465, 487, 510, 519, 632, 623, 629, 633, 640, 654, 222, 229, 114, 641; 226/7; 242/615.11

(56) References Cited

U.S. PATENT DOCUMENTS 2,601,231 A * 6/1952 Smith ..... 251/51
3,263,344 A * 8/1966 Stickle ..... 34/116
3,334,896 A * 8/1967 Mullin ..... 271/74
3,684,277 A * 8/1972 Buschmann ..... 271/46
3,930,319 A * 1/1976 Coleman ..... 34/122
3,962,799 A * 6/1976 Lapointe et al. ..... 34/54
4,192,080 A * 3/1980 Irpola ..... 34/41
4,312,139 A * 1/1982 Preisler et al. ..... 34/54
4,331,150 A * 5/1982 Braun et al. ..... 128/334
4,545,857 A * 10/1985 Wells ..... 162/252
5,156,312 A * 10/1992 Kurie ..... 226/97
5,395,029 A * 3/1995 Kurie ..... 226/97

* cited by examiner

*Primary Examiner*—Denise L. Esquivel
*Assistant Examiner*—K. B. Rinehart
(74) *Attorney, Agent, or Firm*—Selitto, Behr & Kim

(57) ABSTRACT

An adjustable deckel profiler is disclosed, for use in apparatus for drying a moving paper web. The profiler is a slidable member which interacts with impingement air to control and adjust the air against the moving web. Means are provided for adjusting and setting the profiler relative to cross machine drying air profiling.

2 Claims, 1 Drawing Sheet

DECKEL EDGE PROFILER

FIELD OF THE INVENTION

This invention relates to drying systems for web material such as tissue, pulp and paper and using an adjustable deckel in the drying process.

BACKGROUND OF THE INVENTION

In web drying processes it is very important to maintain a uniform edge moisture profile in the cross machine direction and in the machine direction on papermaking drying machines such as paper, pulp and tissue machines, in order to achieve high quality paper production.

Uneven moisture edge profiles can result in overheating of cylinder edges causing over-dried edges of the web, uneven creping on tissue machines, excessive local wear of tissue cylinders, reduced machine production and increase in raw material consumption.

There are several profiling devices on the market, but none of those provide the profiling requirements need in today's industry. The following United States patents provide several examples:

- U.S. Pat. No. 4,312,139 discloses a material web dryer having opening and closing elements for controlling discharge between open, partially closed, or completely closed positions;
- U.S. Pat. No. 3,962,799 discloses a moisture profiler for contacting a moving web, having a pair of sliding valves overlying the inlets from ducts to adjust the hot to warm air ratio;
- U.S. Pat. No. 4,331,150 discloses a steam shower for reducing paper web moisture content in a cross machine direction by varying it's bottom steam discharge area incrementally across the web;
- U.S. Pat. No. 4,192,080 discloses a method for improving the drying characteristics of a cylinder drying section of a paper machine having an even transverse moisture profile;
- U.S. Pat. No. 4,545,857 discloses a steam box for controlling the moisture content of a paper web, which delivers steam to a series of damper controlled compartments that extend across the web;
- U.S. Pat. No. 3,930,319 discloses an apparatus for drying a travelling paper web, having a hot air delivery system adjacent the cylinder, with at least a part of the hot air delivery structure being transversely movable; and
- U.S. Pat. No. 3,263,344 discloses a drying system for a papermaking machine having sleeves that allow transverse movement so that the air discharge can be controlled.

SUMMARY OF THE INVENTION

The present invention addresses the problem of edge sheet uniformity in the drying section of paper, pulp and especially on tissue drying apparatus. It also addresses the problems associated with hot air spillage caused by dryer air boundary layer and balancing of the process air drying equipment.

According to a broad aspect the invention relates to an adjustable deckel profiler for use in an apparatus for drying a moving web of tissue, pulp or paper, said profiler comprising a slidable member for controlling and adjusting hot process impingement air onto said web and which operatively increases or decreases the process air impinging on said web, and means for adjusting and setting said profiler relative to cross-machine drying air profiling.

DESCRIPTION OF THE PREFERRED EMBODIMENT

Figure 1:
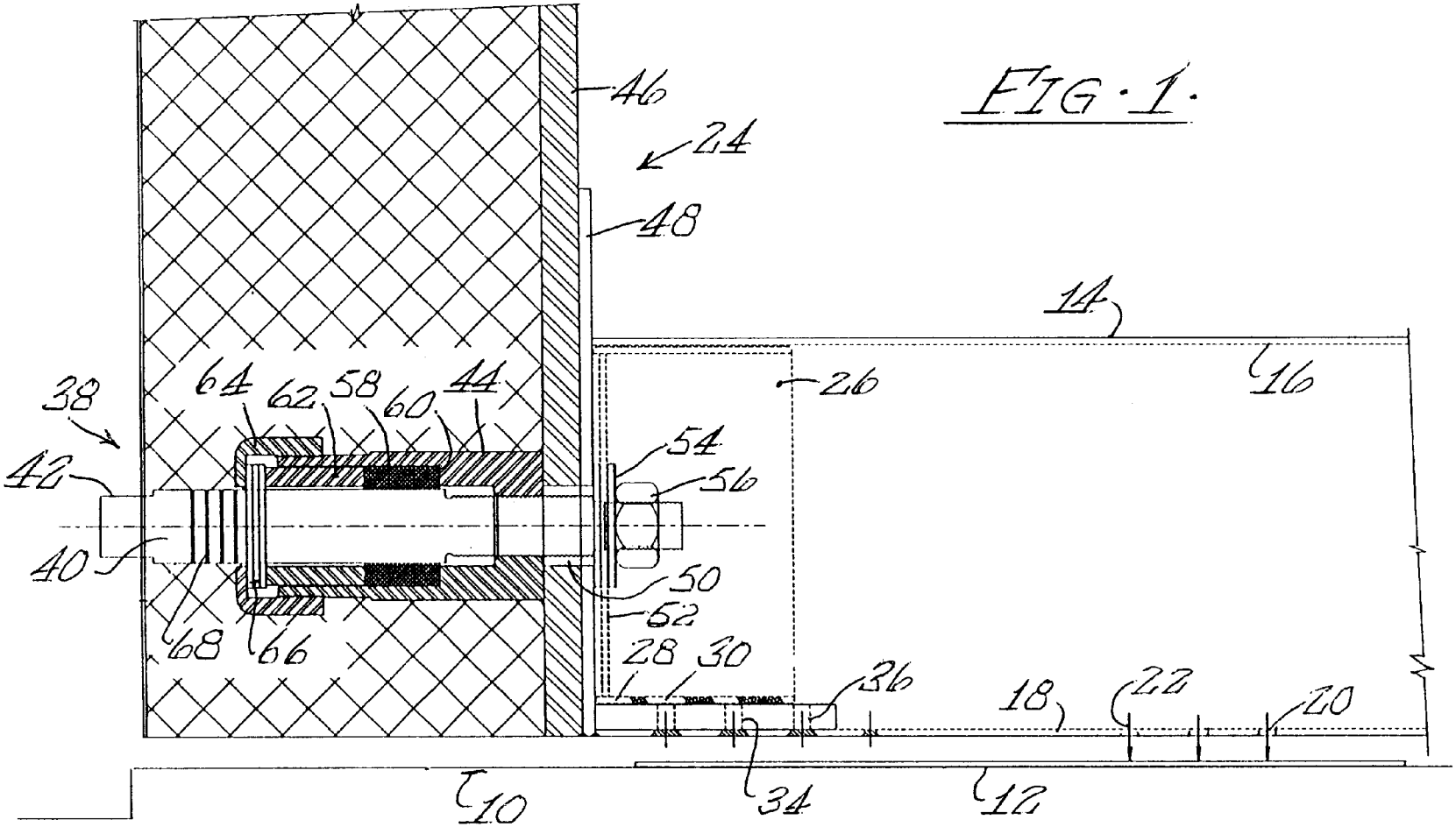
FIG. 1 is a cross-sectional view of a side area of a web drying apparatus illustrating the present invention.

In the drawing, a sectional view of a preferred embodiment of the invention in a material web drying apparatus, is shown. The web drying apparatus includes a cylinder 10 which carries the material sheet 12 to be dried. A nozzle box 14 has upper and lower walls 16, 18 respectively, lower wall 18 being provided with a plurality of apertures 20 through which hot, pressurized air as indicated by the arrows 22 is directed onto the web 12 in the drying process.

In order to provide as much control as possible over the local sheet moisture variances during the drying process, a deckel profiler indicated generally at 24 is provided at the end wall of the nozzle box 14. The profiler 24 is adapted to control and adjust the hot process impingement air onto the web 12 at the marginal areas thereof by means of a sliding member 26 telescopically mounted in the end wall area of the nozzle box 14. As illustrated, the member 26 has a bottom wall 28 that incorporates a plurality of apertures 30 in the form of an adjustable deckel 32. Apertures 30 in the bottom wall 28 of the member are adapted to interact with other apertures 34 spaced along a spillage controller plate 36 which lies intermediate the bottom wall 28 of the slidable member and the bottom wall 18 of the nozzle box 14. It will be appreciated that by moving the slidable member 26 inwardly or outwardly of the nozzle box (to the right or to the left in the drawing) the amount of pressurized air from the interior of the nozzle box being directed through the apertures 34 can be varied depending on the location of the associated apertures 30 in the slidable member 26. Thus, the deckel profiler 24 can control and adjust the hot process impingement air 22 onto the paper sheet in the marginal area thereof, increasing or decreasing the hot process air impinging on the sheet in that area.

The profiler 24 is adapted to provide very small incremental edge cross-machine profiling adjustments and this is accomplished by means of individual adjusters 38. The adjuster 38 consists of an elongated bolt 40 having a tool-engaging outer end 42 and which is threadably engaged for inward and outward movement in a sleeve 44 which is welded to a wall 46 secured to the outer end wall 48 of the nozzle box 14. As shown, wall 46 is provided with an aperture 50 through which the inner end of the bolt 40 extends, eventually entering the confines of the slidable member 26. In that regard, member 26 is provided with an end wall 52 and a pair of washers 54 on the inner end of the bolt 40 engage either side of the wall 52 and are secured in place by means of a nut 56 threaded onto the inner terminal end of bolt 40.

Outwardly of the sleeve 44, bolt 40 is provided with a plurality of seals 58 that are concentrically mounted on the bolt 40 and these sit in a shoulder 60 on the sleeve 44. A seal securing sleeve 62 is slidably mounted over the surface of bolt 40 to engage the seals 58 and pressure on the sleeve 62 and seals 58 is applied by a cup 64 threadably engaging the outer end of sleeve 44 and drawing down on pressure washers 66.

As shown in the drawing, the outer end of bolt 40 is provided with a series of indicator rings or other suitable markings 68.

In operation, the bolt 40 is adjusted inwardly or outwardly by means of rotating the tool engaging end 42 thereof and this action provides a fine inward or outward movement of the slidable member 26 whereby the apertures 30 in the bottom wall thereof either cover or uncover portions of or all of apertures 34 in the spillage controller plate 36. Thus, the profiler 24 provides the capability of controlling process air 22 as well as the cylinder dryer boundary air layer spillage in the area illustrated. The directional control feature in the plate 36 and apertures 30 and 34 provide that control by varying the geometrical configuration of the lower plate through movement of the member 26.

The result of this control will provide more even drying of a sheet in the area described and it will also reduce sheet trimming requirements due to its accurate hot air impingement control onto the sheet 12.

The present invention also provides improvements in edge moisture profiling correction on the tending and drive sides of a drying machine; individual adjustment over the full range of the periphery of the drying apparatus; edge spillage control; control capability of wet and dryer sheet edges; and a reduction in the overheating of edge cylinder surfaces.

While the invention has been described in connection with a specific embodiment thereof and in a specific use, various modifications thereof will occur to those skilled in the art without departing from the spirit and scope of the invention as set forth in the appended claims.

The terms and expressions which have been employed in this specification are used as terms of description and not of limitations, and there is no intention in the use of such terms and expressions to exclude any equivalents of the features shown and described or portions thereof, but it is recognized that various modifications are possible within the scope of the invention claims.

The embodiments of the invention in which an exclusive property or privilege is claimed are defined as follows:

1. An adjustable deckel edge profiler for use in a machine for drying a moving web of tissue, pulp or paper and wherein said machine incorporates at least one nozzle box which includes an outer end wall and a bottom wall with a plurality of apertures in the bottom wall for directing drying air onto said web; said edge profiler comprising means for controlling and adjusting hot process impingement air onto said web at the marginal areas thereof and which operatively increases or decreases the process air impinging on said marginal areas of said web, and means for adjusting and setting said edge profiler relative to cross-machine drying air profiling;

said deckel edge profiler comprising:

a member moveably located in the outer end wall of said nozzle box, said member having a bottom wall with apertures therethrough;

plate means intermediate the bottom wall of said member and the bottom wall of said nozzle box and a series of apertures in said plate means in registry with selected apertures in the bottom wall of said nozzle box; and means for adjusting said moveably located member to bring the bottom wall apertures therein into selective registry with apertures in said plate means so as to selectively increase or decrease said process air impinging on said marginal areas of said moving web.

2. A deckel edge profiler in accordance with claim 1 wherein said adjusting means comprises a rotatable bolt secured at one end to said moveably located member, a sleeve secured to the outer end wall of said nozzle box with said bolt being concentrically located within and threadably engaged to said sleeve; means for rotating said bolt to effect movement of said member, and means for providing an indication of the location of said deckel edge profiler within said nozzle box.

* * * * *